US008602255B2

(12) United States Patent
Song et al.

(10) Patent No.: US 8,602,255 B2
(45) Date of Patent: Dec. 10, 2013

(54) SOCKET CONNECTOR PACKAGING

(75) Inventors: Yong-Jun Song, Shenzhen (CN); Yong-Zhao Huang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/195,010

(22) Filed: Aug. 1, 2011

(65) Prior Publication Data

US 2012/0273511 A1 Nov. 1, 2012

(30) Foreign Application Priority Data

Apr. 28, 2011 (CN) ..... 2011 1 0108713

(51) Int. Cl.
*B65D 43/24* (2006.01)

(52) U.S. Cl.
USPC ..... 220/831; 220/4.22; 220/810

(58) Field of Classification Search
USPC ..... 220/810, 4.21, 4.22, 831, 836, 845, 220/848; 16/348, 350
See application file for complete search history.

(56) References Cited

U.S. PATENT DOCUMENTS 479,936 A * 8/1892 Foster ..... 16/231
2,732,581 A * 1/1956 Heck ..... 220/840
2,852,802 A * 9/1958 Seby ..... 16/356
3,091,357 A * 5/1963 Weinhart ..... 220/845
3,663,990 A * 5/1972 Shane ..... 16/269
4,308,972 A * 1/1982 McReynolds et al. ..... 220/831
4,345,697 A * 8/1982 Wilson et al. ..... 220/831
4,638,909 A * 1/1987 Ford ..... 206/1.7
4,852,725 A * 8/1989 Folsom ..... 206/1.7
4,942,271 A * 7/1990 Corsi et al. ..... 174/101
5,160,213 A * 11/1992 Spiess et al. ..... 404/25
5,234,108 A * 8/1993 Jorgensen ..... 206/575
5,257,721 A * 11/1993 Smith et al. ..... 220/533
5,357,565 A * 10/1994 Butler et al. ..... 379/412
5,397,091 A * 3/1995 Tsuar ..... 248/441.1
5,495,389 A * 2/1996 Dewitt et al. ..... 361/679.57
5,531,345 A * 7/1996 Nakamura et al. ..... 220/3.8
5,860,518 A * 1/1999 Axelrod ..... 206/224
5,893,481 A * 4/1999 Favre ..... 220/831
5,938,063 A * 8/1999 Hoftman ..... 220/326
5,979,016 A * 11/1999 Fan ..... 16/267
6,164,483 A * 12/2000 Walker ..... 220/379
6,257,436 B1 * 7/2001 McGlauflin ..... 220/533
6,437,244 B1 * 8/2002 Vander Velde ..... 174/68.3
6,461,026 B1 * 10/2002 Wang ..... 362/374
6,772,905 B2 * 8/2004 Cheng ..... 220/840
6,875,405 B1 * 4/2005 Mathus et al. ..... 422/562
6,890,196 B2 * 5/2005 Vila ..... 439/165
6,986,434 B1 * 1/2006 Getsy et al. ..... 220/254.3
7,013,530 B2 * 3/2006 Lallemant ..... 16/297

(Continued)

*Primary Examiner* — Anthony Stashick
*Assistant Examiner* — Christopher McKinley
(74) *Attorney, Agent, or Firm* — Altis Law Group, Inc.

(57) ABSTRACT

A socket connector packaging includes a main body and a cover. The main body includes a first sidewall and a pivot positioned on the first sidewall. The cover includes a second sidewall, a coupling portion and a stop portion. The coupling portion and the stop portion are positioned on the second sidewall and opposite to each other. The pivot is placed over the coupling portion, thereby making the cover to be rotatable relative to the main body through the pivot. The stop portion is configured for preventing the cover from further rotating when the pivot contacts with the stop portion.

20 Claims, 4 Drawing Sheets

(56) References Cited

U.S. PATENT DOCUMENTS

| | | | | |
|---|---|---|---|---|
| 7,306,159 | B1 * | 12/2007 | Rochelo | 235/492 |
| 7,612,300 | B2 * | 11/2009 | Owens et al. | 174/480 |
| 7,615,710 | B2 * | 11/2009 | Sayres | 174/480 |
| 7,908,798 | B2 * | 3/2011 | Monneret | 52/20 |
| 8,330,042 | B2 * | 12/2012 | Owens et al. | 174/68.3 |
| 2002/0050374 | A1 * | 5/2002 | Vander Velde | 174/48 |
| 2003/0038142 | A1 * | 2/2003 | Gee | 220/835 |

* cited by examiner

SOCKET CONNECTOR PACKAGING

BACKGROUND

1. Technical Field

The present disclosure relates to the packaging of a socket connector.

2. Description of Related Art

Socket connectors come out of the factory packaged in covers for protecting the electrical terminals from damage. When a user arranges an electric element (e.g. a memory, a microprocessor, a CPU) on a socket connector, the cover must be stripped off.

However, because the cover is in contact with the electric terminals, they may be damaged if the cover is stripped off quickly or thoughtlessly.

Therefore, what is needed is a new socket connector packaging that can overcome the described limitations.

DETAILED DESCRIPTION

Embodiments will now be described in detail with reference to drawings.

Figure 1:
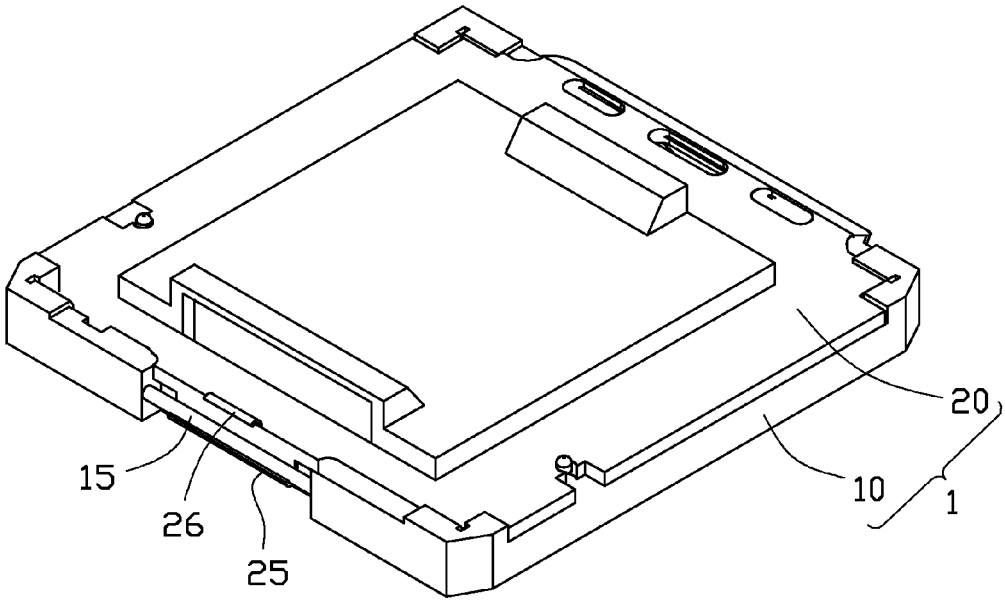
FIG. 1 is an isometric view of a socket connector packaging according to an exemplary embodiment.
Figure 2:
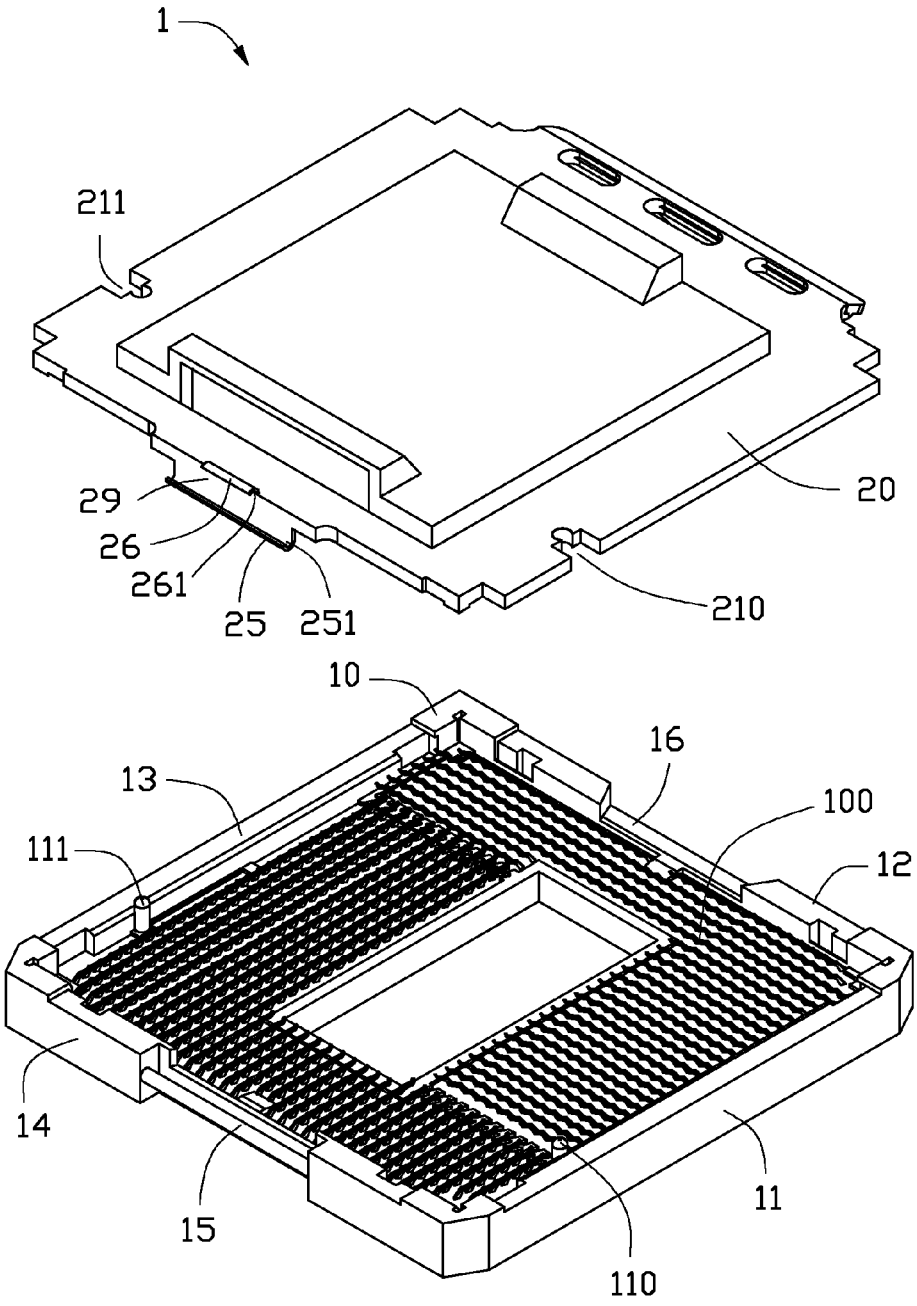
FIG. 2 is an exploded isometric view of the socket connector packaging of FIG. 1.
Figure 3:
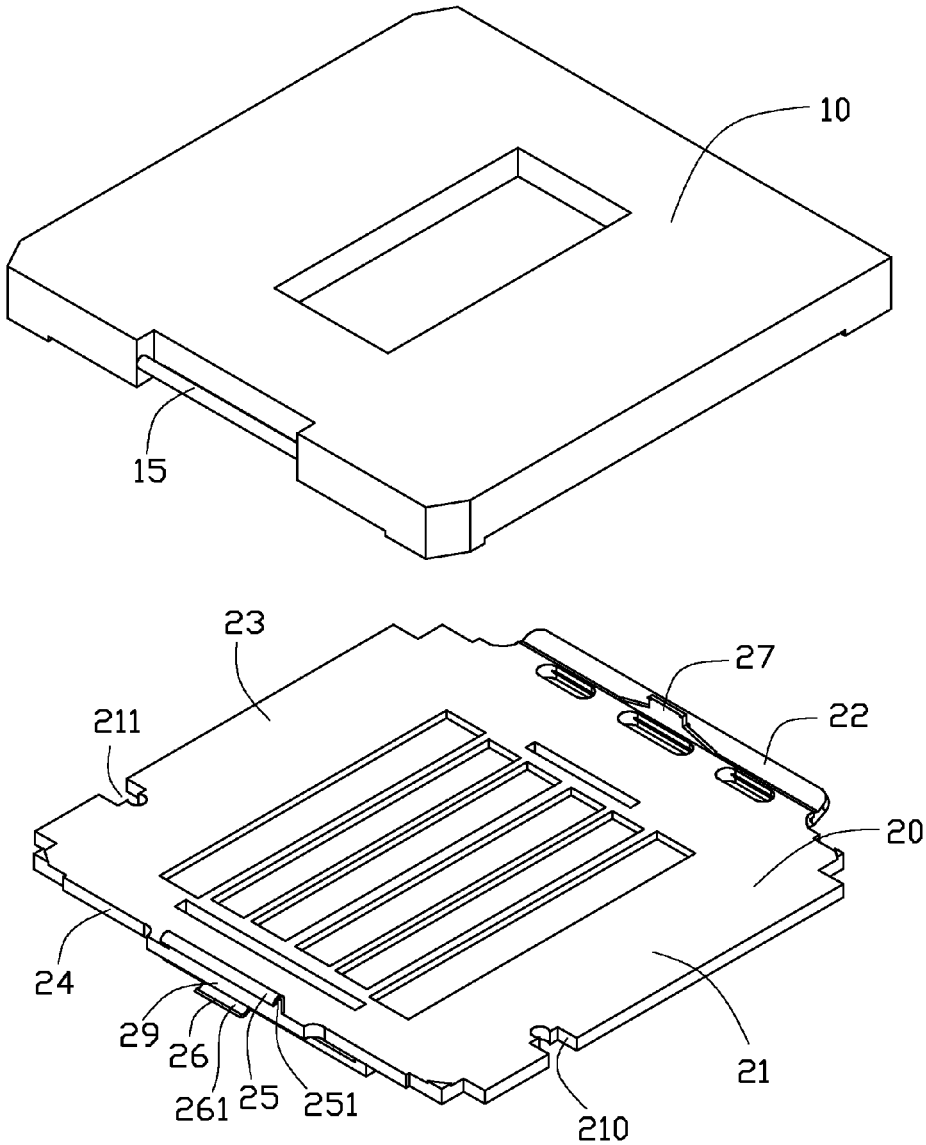
FIG. 3 is similar to FIG. 2, but viewed from another aspect.
Figure 4:
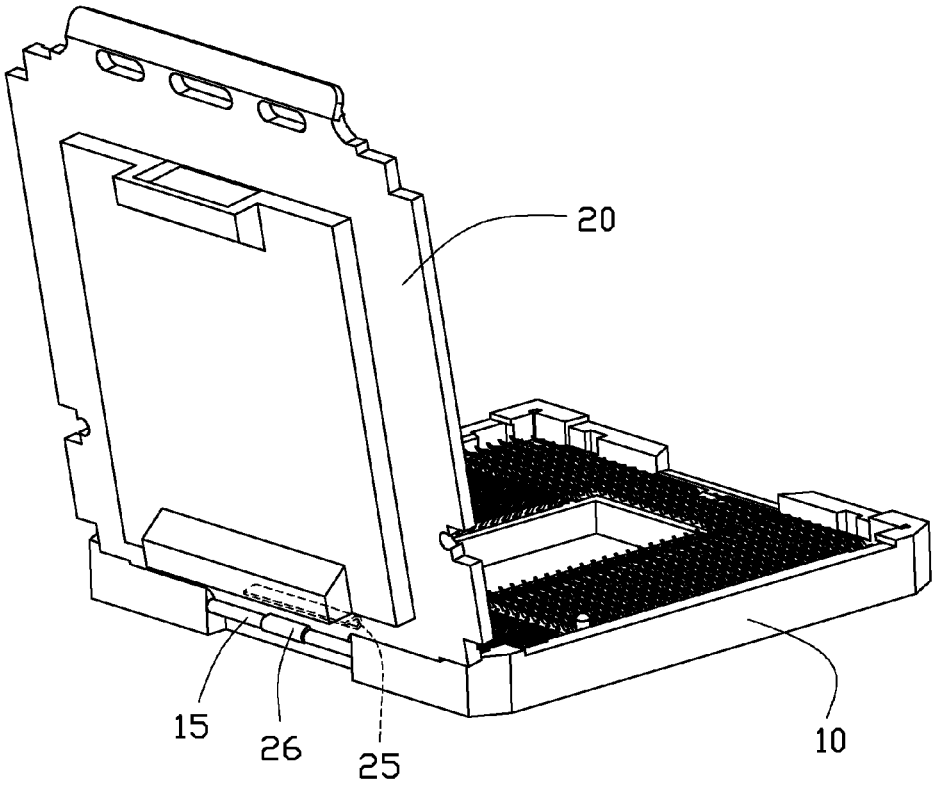
FIG. 4 is an isometric view of the socket connector packaging of FIG. 1 when opened.

Referring to FIGS. 1-4, a socket connector packaging 1, in accordance with an exemplary embodiment, includes a main body 10, and a cover 20.

The main body 10 is a substantially square structure, and is arranged on and electrically connected to a circuit board (not shown). A plurality of electric terminals 100 are arranged in the main body 10, and are electrically connected to the circuit board. The electrical terminals 100 electrically connect the circuit board to an electric element (not shown). In the present embodiment, the electric element is a microprocessor. In other embodiments, the electric element may be a CPU, or a memory.

The main body 10 includes a first sidewall 11, a second sidewall 12, and a third sidewall 13 opposite to the first sidewall 11, as well as a fourth sidewall 14 opposite to the second sidewall 12.

A first locating post 110 is arranged on the main body 10, and is near the first sidewall 11. A second locating post 111 is arranged on the main body 10, and is near the third sidewall 13. The first and second locating posts 110, 111 are configured for locating the main body 10 to the cover 20. A first opening 16 is defined at a central portion of the second sidewall 12. A hinge rod or dowel (pivot 15) is arranged at a central portion of the fourth sidewall 14. The cover 20 is connected to the main body 10 with the pivot 15 and may be opened or closed like a book. In alternative embodiments, the first opening 16 may be defined at the first sidewall 11 or the third sidewall 13.

The cover 20 is a substantially square structure, and includes a fifth sidewall 21, a sixth sidewall 22, and a seventh sidewall 23 opposite to the fifth sidewall 21, as well as a eighth sidewall 24 opposite to the seventh sidewall 23.

A first notch 210 is defined in the fifth sidewall 21 to receive the first locating post 110. A second notch 211 is defined in the seventh sidewall 23 to receive the second locating post 111. Accordingly, the cover 20 when closed is always aligned squarely with the main body 10.

A fastener 27 is arranged on a central portion of the sixth sidewall 22. In the illustrated embodiment, the fastener 27 is a tongue. The fastener 27 is received in the opening 16, such that the cover 16 can be locked down to the main body 10.

A coupling portion 25 and a stop portion 26 are arranged at a central portion of the eighth sidewall 24. In the illustrated embodiment, the coupling portion 25 is a catch which resembles the lower part of the letter "J" in shape and is placed under the pivot 15, such that the cover 16 can rotate relative to the main body 10 on the pivot 15. A first receiving space 251 is defined by the coupling portion 25; and when the cover 20 covers the main body 10, the pivot 15 is partly received in the first receiving space 251 of the coupling portion 25.

The stop portion 26 is opposite to the coupling portion 25, such that the pivot 15 can be located between the coupling portion 25 and the stop portion 26. In the present embodiment, a cross section of the stop portion 26 is substantially arc-shaped, and the stop portion 26 defines a second receiving space 261. When the cover 20 is opened to the position shown in FIG. 4, the pivot 15 is partly received in the second receiving space 261 of the stop portion 26. A second opening 29 is defined between the coupling portion 25 and the stop portion 26. The second opening 29 provides space that allows the coupling portion 25 to move down further below the pivot 15 without the stop portion 26 interfering with the pivot 15 at the time the cover 20 is opened. Thereby, the cover 16 can be freely rotated up from the main body 10 around the pivot 15.

When a user puts his/her finger into the opening 16 and pulls the cover 20 away from the main body 10, the sixth sidewall 22 moves away from the second sidewall 12, as the cover 16 hinges and rotates away from the main body 10.

When the pivot 15 contacts the stop portion 26, further rotation of the cover 16 is prevented, and the stop portion 26 is positioned over the pivot 15 (i.e. the pivot 15 enters the second receiving space 261 of the stop portion 26). Accordingly, the cover 16 can be fixed at this position. When the cover 16 is open, it can be manually separated from the main body 10.

In the present embodiment, when an angle between the cover 16 and the main body 10 is brought to seventy-five degrees, the rotation of the cover 16 is prevented by the stop portion 26 (i.e. when angle between the cover 16 and the main body 10 is brought to seventy-five degrees, the pivot 15 has come out of the coupling portion 25, and enters the second receiving space 261 of the stop portion 26). Understandably, when the rotation of the cover 16 is prevented, the angle between the cover 16 and the main body 10 can be changed by the user based on need.

The functions of the coupling portion 25 and the stop portion 26 together prevent the angle between the cover 16 and the main body 10 exceeding preset degrees, and in the opening or rotating process, all of the electric terminals 100 are protected from damage.

While certain embodiments have been described and exemplified above, various other embodiments will be apparent from the foregoing disclosure to those skilled in the art. The disclosure is not limited to the particular embodiments described and exemplified but is capable of considerable variation and modification without departure from the scope and spirit of the appended claims.

What is claimed is:

1. A socket connector packaging comprising:

a main body comprising a first sidewall and a pivot positioned on the first sidewall; and a cover, the cover comprising a second sidewall, a coupling portion and a stop portion, the coupling portion and the stop portion being positioned on the second sidewall and opposite to each other, the pivot being positioned between the coupling portion and the stop portion, and the cover being rotatable relative to the main body around the pivot;

wherein when the cover covers the main body, the pivot is positioned over the coupling portion and is not in contact with the stop portion; and when the cover is opened, the coupling portion is not in contact with the pivot and the stop portion contacts the pivot.

2. The socket connector packaging of claim 1, wherein the main body further comprises a locating post, and the cover further defines a locating notch to receive the locating post when the cover covers the main body.

3. The socket connector packaging of claim 1, wherein the cover further comprises a fastener, and the main body further comprises an opening to receive the fastener when the cover covers the main body.

4. The socket connector packaging of claim 1, wherein a cross section of the stop portion is arc-shaped, and the stop portion defines a receiving space by the arc-shape; and when the cover is opened, the pivot is partly received in the receiving space of the stop portion.

5. The socket connector packaging of claim 4, wherein a cross section of the coupling portion in shape resembles the lower part of the letter "J", and the lower part of the letter "J" of the coupling portion defines a receiving space; and when the cover covers the main body, the pivot is partly received in the receiving space of the lower part of the letter "J" of the coupling portion.

6. The socket connector packaging of claim 3, wherein the main body is a substantially square structure, the main body comprises another sidewall opposite to the first sidewall, and the opening is located in the another sidewall of the main body.

7. The socket connector packaging of claim 5, wherein an opening is defined between the coupling portion and the stop portion, the opening is configured for making the pivot come out of a space between the coupling portion and the stop portion so as to separate the cover and the main body.

8. The socket connector packaging of claim 5, wherein the second sidewall includes a top end and a bottom end opposite to the top end, the coupling portion is connected the bottom end, and the stop portion is connected the top end and extends away from the cover.

9. The socket connector packaging of claim 5, wherein when an angle between the cover and the main body is seventy five degrees, the pivot comes out of the receiving space of the coupling portion and enters into the receiving space of the stop portion.

10. A socket connector packaging comprising:

a main body comprising a first sidewall and a pivot positioned on the first sidewall; and a cover, the cover comprising a second sidewall, a coupling portion and a stop portion, the coupling portion and the stop portion being positioned on the second sidewall and opposite to each other, the pivot being located between the coupling portion and the stop portion, and the cover be rotatable relative to the main body around the pivot;

wherein when the cover is in a first position covering the main body, the pivot is engaged in the coupling portion and is not in contact with the stop portion; and when the cover is rotated from the first position to a second position to form a predetermined angle relative to the main body, the coupling portion is not in contact with the pivot and the stop portion contacts the pivot.

11. The socket connector packaging of claim 10, wherein a cross section of the coupling portion in shape resembles the lower part of the letter "J", the coupling portion defines a receiving space, and when the cover in the first position, the pivot is partly received in the receiving space of the coupling portion.

12. The socket connector packaging of claim 11, wherein a cross section of the stop portion is arc-shaped, the stop portion defines a receiving space, and when the cover is in the second position, the pivot is partly received in the receiving space of the stop portion.

13. The socket connector packaging of claim 12, wherein an opening is defined between the coupling portion and the stop portion, the opening is configured for making the pivot come out of a space between the coupling portion and the stop portion so as to separate the cover and the main body.

14. The socket connector packaging of claim 13, wherein the second sidewall includes a top end and a bottom end opposite to the top end, the coupling portion is connected the bottom end, and the stop portion is connected the top end and extends away from the cover.

15. The socket connector packaging of claim 5, wherein when an angle between the cover and the main body is seventy five degrees, the pivot comes out of the receiving space of the coupling portion and enters into the receiving space of the stop portion.

16. A foldable apparatus comprising:

a main body comprising a pivot; and a cover, the cover comprising a sidewall, a coupling portion and a stop portion, the coupling portion and the stop portion being positioned on the sidewall and being opposite to each other, the pivot being located between the coupling portion and the stop portion, and the cover being rotatable relative to the main body around the pivot;

wherein when the cover is in a first position covering the main body, the pivot is located over the coupling portion and is not in contact with the stop portion; and wherein when the cover is rotated from the first position to a second position to form a predetermined angle relative to the main body, the coupling portion is not in contact with the pivot and the stop portion contacts the pivot.

17. The apparatus of claim 16, wherein a cross section of the coupling portion in shape resembles the lower part of the letter "J", the coupling portion defines a receiving space, and when the cover in the first position, the pivot is partly received in the receiving space of the receiving space.

18. The apparatus of claim 17, wherein a cross section of the stop portion is arc-shaped, the stop portion defines a receiving space, and when the cover is in the second position, the pivot is partly received in the receiving space of the stop portion.

19. The apparatus of claim 18, wherein an opening is defined between the coupling portion and the stop portion, the opening is configured for making the pivot come out of a space between the coupling portion and the stop portion so as to separate the cover and the main body.

20. The apparatus of claim 19, wherein the second sidewall includes a top end and a bottom end opposite to the top end, the coupling portion is connected the bottom end, and the stop portion is connected the top end and extends away from the cover.

* * * * *